United States Patent [19]

Klapp

[11] Patent Number: 4,955,929

[45] Date of Patent: Sep. 11, 1990

[54] DEVICE FOR INTRODUCING MATERIAL INTO CONTAINERS

[75] Inventor: Hartmut Klapp, Kaarst, Fed. Rep. of Germany

[73] Assignee: Jagenberg Aktiengesellschaft, Dusseldorf, Fed. Rep. of Germany

[21] Appl. No.: 298,083

[22] Filed: Jan. 17, 1989

[30] Foreign Application Priority Data

Jan. 19, 1988 [DE] Fed. Rep. of Germany ..... 3801279

[51] Int. Cl.[5] ..... B65B 5/10; B65B 39/00

[52] U.S. Cl. ..... 53/244; 53/251; 53/259

[58] Field of Search ..... 53/244, 249, 250, 251, 53/259, 534

[56] References Cited

U.S. PATENT DOCUMENTS

| | | | |
|---|---|---|---|
| 2,061,490 | 11/1936 | Thompson et al. | 53/244 X |
| 2,966,016 | 12/1960 | Meyers | 53/251 X |
| 3,102,374 | 9/1963 | Lloyd et al. | 53/244 X |
| 3,332,200 | 7/1967 | Englander | 53/251 X |
| 4,273,491 | 6/1981 | Roux | 53/250 X |

*Primary Examiner*—Robert L. Spruill
*Assistant Examiner*—Linda B. Johnson
*Attorney, Agent, or Firm*—Sprung Horn Kramer & Woods

[57] ABSTRACT

A device for introducing material into containers with a material-release mechanism and with a structure that supports a container below the material-release mechanism and that can advance the container past the material-release mechanism. The supporting structure has a rocker bearing on which the container rocks back and forth. The point at which it supports the container is displaced to the rear as the container travels forward such that the displacement in the center of gravity of the container as it fills up both occasions an advance in relation to the material-release mechanism and brakes it as the container advances.

14 Claims, 4 Drawing Sheets

DEVICE FOR INTRODUCING MATERIAL INTO CONTAINERS

BACKGROUND OF THE INVENTION

The invention relates to a device for introducing material into containers with a material-release mechanism and with a structure that supports a container below the material-release mechanism and that can advance the container past the material-release mechanism.

The container-supporting structure in a known device of this type (German 2 261 416 C3) consists of a horizontal conveyor belt that is subject to a brake. The material-release mechanism is a pair of belts that grips overlapping folding-box blanks as they arrive horizontally, deflects them out of the horizontal and into the vertical over a curved section, and introduces them into shipping cartons that are open at the top over their total length. This procedure is possible because the lower end of the inner conveyor belt in the curved pair of belts is positioned stationary above the shipping carton, whereas the lower end of the outer conveyor belt can be raised and lowered and accordingly positioned far enough inside the shipping carton. The pressure exerted by the blanks arriving upstream of the end of the outer conveyor belt that extends into the shipping carton generates a force on the shipping carton in the direction of conveyance that counteracts the braking force and automatically occasions the advance motion associated with a full carton. Switching from a full shipping carton to the next carton requires extracting the lower end of the outer conveyor belt out of the full carton and introducing it into the next. This inescapable procedure demands a special design and controls and accordingly adds to the expense of the overall device.

In another device for introducing material, full packages in this case, into shipping cartons that are open at the top, the cartons being loaded are positioned on a supporting and conveying structure on a sloping plane. The material-release mechanism that introduces the packages into the shipping carton terminates above the carton. In contrast to the previously described state of the art, the shipping carton is not advanced automatically in this device by the packages in the carton but by an advance mechanism that acts directly on the carton. The only purpose of the sloping orientation of the carton is to shift the introduced packages to one end of the carton. This device is also comparatively expensive due to the separate controls for the advance mechanism.

OBJECT OF THE INVENTION

The object of the present invention is to provide a device of the aforesaid type that will be less expensive to manufacture and will ensure smooth introduction of the material into the containers and switching from one container to the next with no need for externally controlled motions of the separate components of the device.

This object is attained in accordance with the invention in that the supporting structure has a rocker bearing on which the container rocks back and forth, whereby the point at which it supports the container is displaced to the rear as the container travels forward such that the displacement in the center of gravity of the container as it fills up both occasions an advance in relation to the material-release mechanism and brakes it as the container advances.

Since the pressure of the arriving material on the section of the material-release mechanism that extends into the container is no longer needed to advance the container as it is in the prior art, the material-release mechanism can terminate above the container, and no adjustments will be necessary when switching the loading procedure from one container to another.

One particularly advantageous embodiment of the invention has a stop in the form of a brake that counteracts the forward motion and limits the tilting of the container occasioned by the forward motion. Thus the container moves forward automatically in accordance with how full it is because the reduction in excess weight that occurs as more material is introduced into the container and increases on the other side of the rocker bearing decreases the braking force until the excess weight at one end becomes powerful enough to generate a braking force that will stop the container.

The brake can to advantage be a friction brake. It can act directly on the container.

The structure that supports the containers can have a sloping supporting surface that is steep enough to ensure that the containers will slide down strictly due to gravity.

The device can also have a rocker bearing that is positioned stationary in the supporting structure and controlled by an additional friction-generating structure, especially a friction spring positioned upstream of the rocker bearing and exerting additional braking force on the forward motion.

The device will accordingly not need a live advance mechanism. The containers will slide forward automatically as they fill up and will also be automatically braked due to the increase in the braking force as they slide forward. The additional friction-generating structure increases the precision of control.

One embodiment of the invention employs specific mechanisms instead of gravity to induce the forward motion. The more or less horizontal surface that the container rests on can be comprised of the rocker bearing and of a live advance mechanism, whereby one tilting motion occasioned by the displacement of its center of gravity as the container fills up positions it on the advance mechanism and the tilting motion in the opposite direction occasioned by the displacement of its center of gravity as it moves forward lifts it off of the advance mechanism. The advance mechanism can be a driven friction roller.

The forward motion in this embodiment is automatically engaged and disengaged by the back and forth motion of the rocker bearing in accordance with how full the container is and requires no separate controls.

The device can also have means of shifting the rocker bearing toward the point of displacement of the center of gravity of the container as it fills up. This design automatically ensures very high precision in relation to controlling the loading position of the material-release mechanism.

The rocker bearing can be a roller. The base will accordingly exert no further braking forces on the container.

Although the roller can be stationary, its function will be more effective if the roller travels over a stationary path on a radius that is as long as or shorter than the radius that the section of the roller that supports the container rolls on. The stationary path can in particular slope down along the direction in which the container moves forward.

The ratio between the radii that the roller travels on can ensure that the center of mass of the container, which is dictated by the amount of material introduced, will remain essentially above its point of support as it moves forward. The advantage of this situation is that conditions at the brake due to the tilting of the container will remain essentially constant while all the material is introduced into the container. Furthermore, the geometric relations between the upper position of the introduced material and the material-release mechanism will remain constant. A slightly shorter radius will increase the braking force as the center of mass migrates beyond the point of support. A more powerful braking force is needed to maintain effective braking action as the container fills up.

Obviously, the combination of materials that the roller, the path, and the container are made of must ensure that the rolling action will be as free of slipping as possible.

The rocker bearing in one embodiment can consist of two similar and alternately engaging rollers that are driven in conjunction such that the roller that is currently in use and is accordingly moving from an initial position into a terminal position returns the idling roller out of the terminal position into the initial position and vice versa. This system makes the operation of the device completely automatic and eliminates the need to manually restore the roller to its initial position in readiness for the next container. It can be realized by securing the rollers to continuous tensioning means, such as a chain, a cord, or a belt traveling around pulleys.

BRIEF DESCRIPTION OF THE DRAWINGS

Two embodiments of the invention will now be specified by way of example with reference to the schematic drawings.

FIGS. 1 through 3 are side views of the device at various stages of the loading process.

FIG. 4 is a view of the vicinity of the materialrelease mechanism of the device illustrated in FIGS. 1 through 3 from the direction indicated by arrow B.

FIG. 5 is a top view of the device illustrated in FIGS. 1 through 3 from the direction indicated by arrow A.

DETAILED DESCRIPTION OF THE INVENTION

Figure 4:
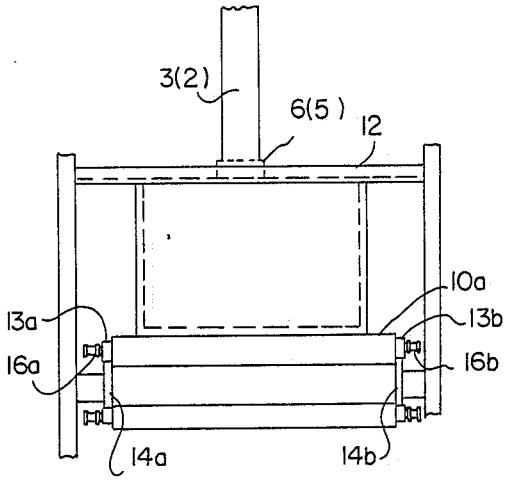
Figure 5:
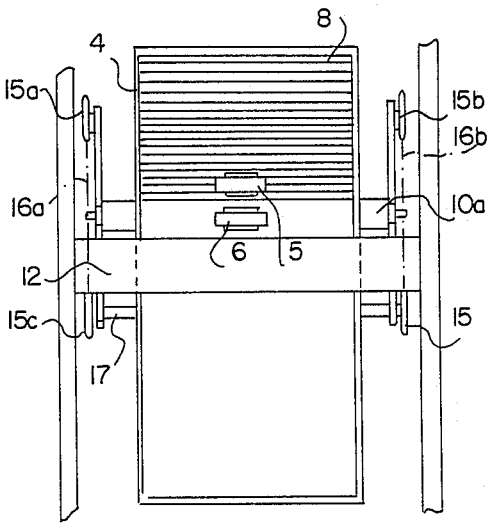
Figure 6:
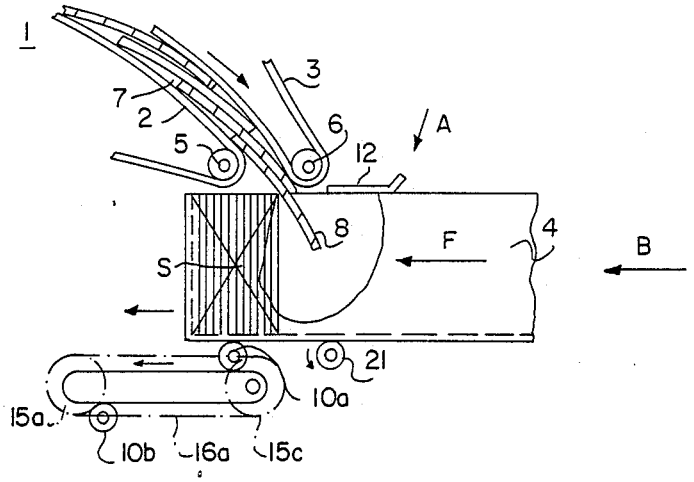
FIG. 6 is a side view of a device in accordance with the invention in which the containers are advanced by means of a live friction roller.

The devices illustrated in FIGS. 1 through 5 and in FIG. 6 have a material-release mechanism 1 that consists of two continuous conveyor belts 2 and 3 traveling over pulleys 5 and 6 in the vicinity of a container 4 that is to be loaded and leaving between them a space 7 within which they advance foldup-box blanks 8 that arrive overlapped. The container 4, a parallelepipedal shipping carton that is open at the top, rests on a supporting structure with some its supporting surface consisting of a rocker bearing 10, i.e. 10*a* or 10*b* in the form of a roller.

The supporting surface in the embodiment illustrated in FIGS. 1 through 5 is further constituted by a roller conveyor 9 that is positioned in relation to rocker bearing 10 such that container 4 rests on them at an angle and tends, due to its inherent weight, to advance in the direction indicated by arrow F.

The more or less horizontal surface that supports container 4 in the embodiment illustrated in FIG. 6 consists of a rocker bearing 10*a* and of a live advance mechanism 21, a live friction roller in the present case.

Both embodiments have a stop 12 that extends at an angle above the vicinity of container 4 that remains to be loaded and limits the tilting motion of the container, counterclockwise in the drawing, that occurs as the result of excess weight when it is partly loaded with foldup-box blanks 8. Stop 12 acts directly on container 4 in the capacity of a frictional brake.

Rocker bearing 10, which is most clearly indicated in FIGS. 4 and 5, has supporting wheels 13*a* and 13*b* at each end that travel over paths 14*a* and 14*b* in the form of stationary rails. The active radius of supporting wheels 13*a* and 13*b* is as long as or slightly shorter than that of the roller that constitutes rocker bearing 10*a* where it supports container 4. The ratio between the respective radii is such that the ratio of their associated circumferences will be 1:1. Each end of rocker bearing 10*a* is secured to a continuous chain 16*a* and 16*b* that travels around pulleys 15*b*–15*d*. Pulleys 15*c* are 15*d* are connected by a shaft to ensure synchronization. Also attached to chains 16*a* and 16*b* is another and similar rocker bearing 10*b* that is half a chainlength away from rocker bearing 10*a* on the other side of the mechanism. Second rocker bearing 10*b* alternates with first rocker bearing 10*a* in supporting containers 4 and 4'. Loaded containers 4 or 4' are removed on a horizontal conveyor belt 18.

The device in accordance with the invention is completely automatic, and its function will now be described with reference to FIGS. 1 through 5.

The center S of gravity of a partly loaded container 4 is to the left of a perpendicular through rocker bearing 10*a*. The container rests against stop 12 which brakes it and impedes its motion in the direction indicated by arrow F.

The level of braking force depends on the excess weight of container 4 to the left of the perpendicular through rocker bearing 10*a*. As more blanks 8 are added to container 4, its center S of gravity will shift to the right and the excess weight to the left of the perpendicular will decrease. The force with which container 4 rests against stop 12 and which establishes the braking force will also decrease. Thus, as more blanks are added, a state will occur in which the braking force will no longer be sufficient to retain container 4, which will begin moving in the direction indicated by arrow F until the excess weight to the left of the perpendicular through rocker bearing 10*a* is sufficient to generate adequate braking force at stop 12 again.

The container 4 being loaded in the embodiment illustrated in FIG. 6 rests more or less horizontally on rocker bearing 10*a* and on a friction roller 21 positioned at some distance away from it upstream. As long as the center S of gravity of the container 4 being loaded is downstream of rocker bearing 10*a*, to the left of it in FIG. 6, the top of the container will rest against container 4 and its bottom will be lifted off of advance mechanism 21. As more blanks 8 are added, the center of gravity will migrate to the right until it is upstream of rocker bearing 10*a*, at which time container 4 will rest on live advance mechanism 21, which will advance the container until its center of gravity migrates back to the left of the base and lifts the container again. At that instant stop 12 will again brake the forward motion of the container with no need for a live mechanism.

Since rocker bearing 10*a* is not stationary in either embodiment but moves along paths 14*a* and 14*b*, the forward motion of container 4 will also induce rocker bearing 10*a* to move in the same direction.

The essentially equal active radii of the roller in rocker bearing 10*a* and its supporting wheels 13*a* and 13*b* of course result in different travels in relation to a stationary reference point. If the circumference of the roller is as long as that of the supporting wheels, container 4 will move twice as far as the rollers. Comparing the partly loaded container 4 in FIG. 1 with the completely loaded container 4 in FIG. 2 will demonstrate how the approximately equal supporting-wheel radii keep the center of mass of the partly or completely loaded container 4 essentially always perpendicularly above rocker bearing 10*a*. The result is very high precision in controlling the loading position of the material-release mechanism in relation to container 4 in accordance with how full it is because it becomes possible to react to small displacements of center S of gravity by moving the container forward or by braking it. To maintain these functions of rolling and of displacement of the center of mass it is important to prevent the rollers from slipping either in relation to the container or to its path. This can be ensured by coating the rollers with a high-friction material.

Figure 2:
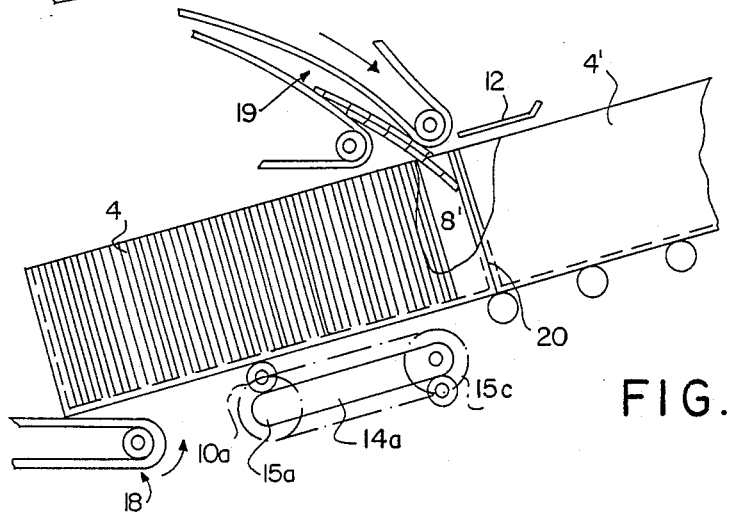

In switching from loading one container 4 to loading the next container 4' with blanks, it is conventional to leave a gap 19 in the stream of overlapping blanks 8. Once a full container 4 leaves the operating range of stop 12 and hence of the braking force just before the loading procedure is complete, and once its forward edge has arrived on conveyor belt 18, it will be prevented from moving forward uncontrolled in the direction indicated by arrow F by the stream of final blanks 8', which will still be retained by the stationary outlet from material-release mechanism 1 and will rest against the rear wall 20 of container 4 as illustrated in FIG. 2.

Figure 1:
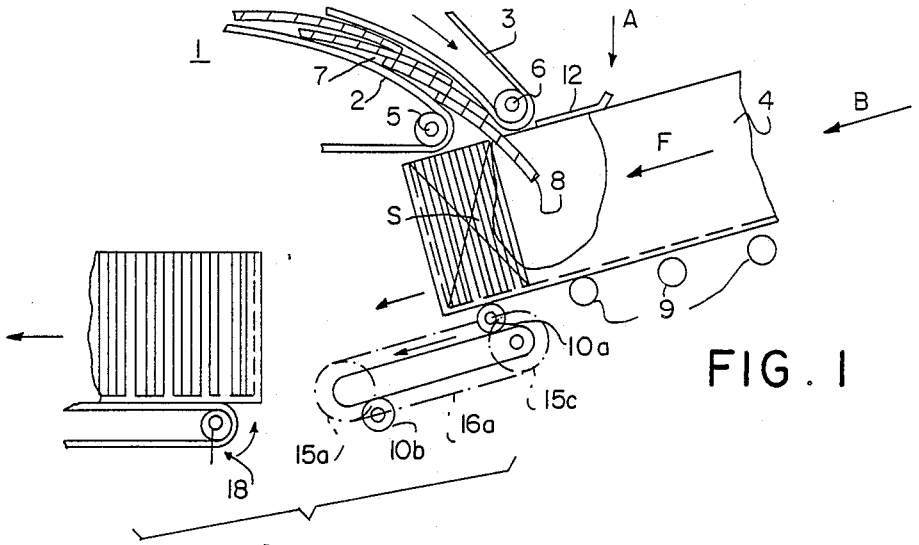
FIGS. 1 through 5 represent an embodiment wherein the forward motion of the containers is obtained by allowing them to slide down subject to gravity.
Figure 3:
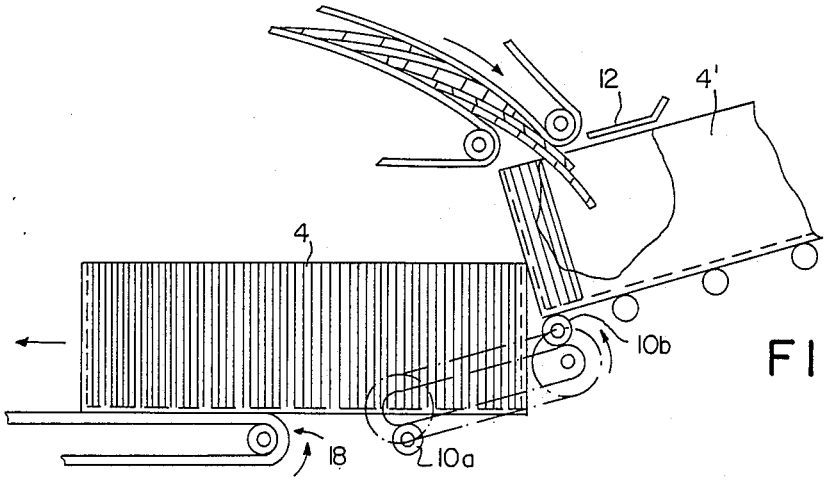

As the full container 4 is conveyed onward by conveyor belt 18, the container will drive rocker bearing 10*a* into the position represented in FIG. 3, simultaneously shifting rocker bearing 10*b* into its initial position ready for the next container 4' (FIG. 3). At this stage, the motion of container 4' will be dictated by the forward motion of container 4 by way of conveyor belt 18. Since there will as yet be no excess weight in container 4' to the left of the perpendicular through rocker bearing 10*b* to force it against stop 12, the stop will be unable to exert any braking action. Container 4' will accordingly move forward along with the previous container 4, either subject to its own inherent weight or driven by advance mechanism 21 and secured by container 4. Only once container 4' has been loaded with a certain number of blanks 8 as illustrated in FIG. 1 or 6, will the excess weight be sufficient to tilt the container and force it against stop 12. The loading sequence will accordingly be repeated.

The design of the embodiment with the sloping supporting surface illustrated in FIGS. 1 through 5 and through which containers 4 travel as the result of their inherent weight will be simpler if not extreme demands are made on the precision with which it is controlled. In this case it is possible to mount the rocker bearing stationary, unmoving that is, in the supporting structure. In the simplest case the rocker bearing will then consist of a rod or roller extending across the direction of travel. Since the center of gravity in this embodiment will become increasingly remote from the rocker bearing along the direction of travel as the container is loaded and since the braking force will not relate linearly to the driving force that generates the forward motion, an additional friction-generating structure, a friction spring for example, must be positioned upstream of the rocker bearing to exert extra braking force. This braking force will, especially at the beginning of the loading process, augment the retaining force while it is still insufficient due to the low excess weight. The additional friction-generating structure will increase the precision of control, especially while the container is still light in weight at the commencement of the loading process.

Figure 7:
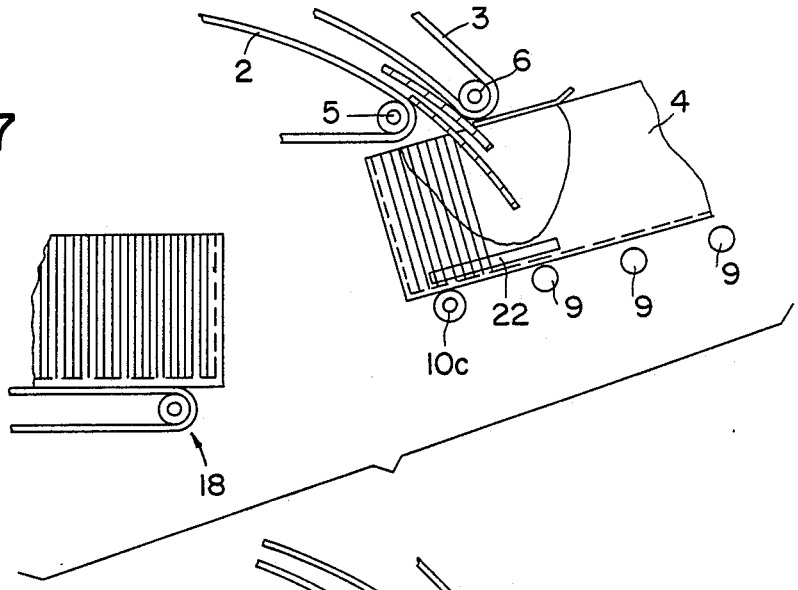
FIGS. 7 and 8 are side views of a modified embodiment with an additional friction-braking spring.
Figure 8:
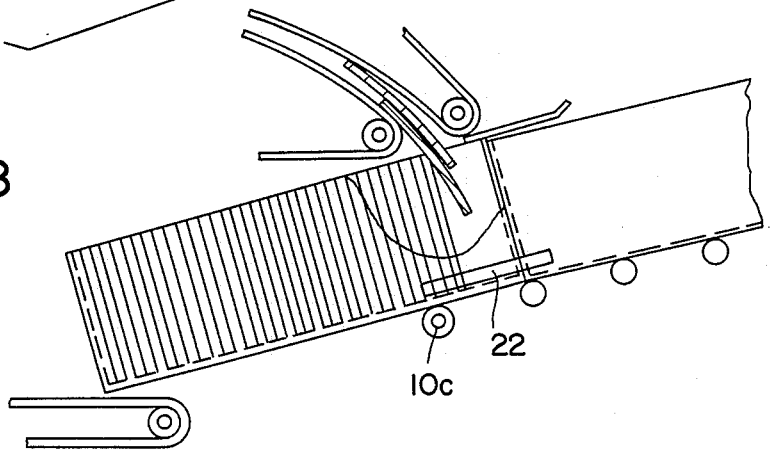
Figure 9:
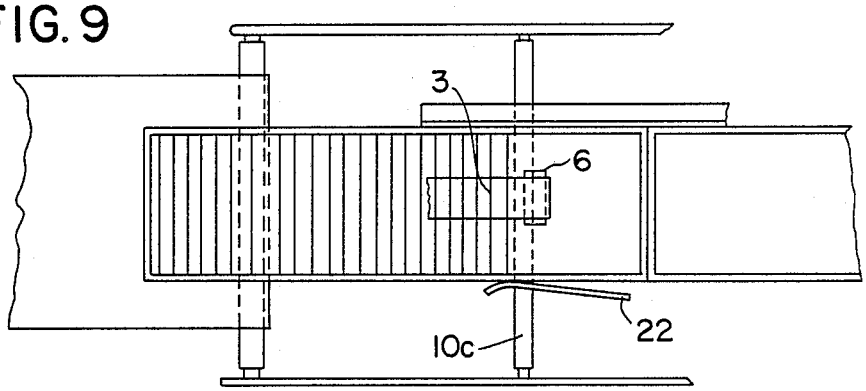
FIG. 9 is a top plan view of FIG. 8.

The embodiment of FIGS. 7 to 9 shows a rocker bearing 10*c* mounted stationary int he supporting structure. A friction spring 22 is positioned upstream of the rocker bearing 10*c* and exerts an additional braking force on the forward motion.

It is understood that the specification and embodiments are illustrative but not limitative of the present invention and that other embodiments within the spirit and scope of the invention will suggest themselves to those skilled in the art. In particular, although the embodiments described herein relate to the introduction of flat materials, especially foldup-box blanks, into shipping cartons, the invention is also appropriate for discrete products of other shapes and even for bulk goods and pastes in that the automatic advance of the container does not depend on the type of material being loaded.

What is claimed is:

1. In a device for introducing material into containers with a material-release mechanism and with a supporting structure that supports a container below the material-release mechanism and that can advance the container past the material-release mechanism, the improvement wherein the supporting structure has a bearing on which the container pivots, whereby the point at which said bearing supports the container is displaced to the rear as the container travels forward such that the displacement int eh center of gravity of the container as it fills up both occasions an advance of the container in relation to the material-release mechanism and brakes the container as it advances.

2. Device as in claim 1, with a stop in the form of a brake that counteracts the forward motion and limits the tilting of the container occasioned by the forward motion.

3. Device as in claim 2, wherein the brake is a friction brake.

4. Device as in claim 1, wherein the structure that supports the containers has a sloping supporting surface that is steep enough to ensure that the containers will slide down strictly due to gravity.

5. Device as in claim 1, wherein the bearing is positioned stationary int he supporting structure and controlled by a friction spring positioned upstream of the bearing and exerting additional braking force on the forward motion.

6. Device as in claim 1, wherein the surface that the container rests on is approximately horizontal and is comprised of the bearing and of a live advance mechanism, whereby one tilting motion occasioned by the displacement of its center of gravity as the container fills up positions it on the advance mechanism and the tilting motion in the opposite direction occasioned by the displacement of its center of gravity as it moves forward lifts it off of the advance mechanism.

7. Device as in claim 1, wherein the advance structure is a driven friction roller.

8. Device as in claim 1, with means of shifting the bearing toward the point of displacement of the center of gravity of the container as it fills up.

9. Device as in claim 1, wherein the rocker bearing is a roller.

10. Device as in claim 9, wherein the roller travels over a stationary path on a radius that is as long as or shorter than the radius that the section of the roller that supports the container rolls on.

11. Device as in claim 10, wherein the ration between the radii that the roller travels on ensures that the center of mass of the container will remain essentially above its point of support as it moves forward.

12. Device as in claim 10, wherein the stationary path slopes down along the direction in which the container moves forward.

13. Device as in claim 1, wherein the bearing consists of two similar and alternately engaging rollers that are driven in conjunction such that the roller that is currently in use and is accordingly moving from an initial position into a terminal position returns the idling roller out of the terminal position into the initial position and vice versa.

14. Device as in claim 1, wherein the rollers are secured to continuous tensioning means, such as a chain, a cord, or a belt traveling around pulleys.

* * * * *

UNITED STATES PATENT AND TRADEMARK OFFICE

CERTIFICATE OF CORRECTION

PATENT NO. : 4,955,929

DATED : September 11, 1990

INVENTOR(S) : Haetmut Klapp

It is certified that error appears in the above-identified patent and that said Letters Patent is hereby corrected as shown below:

Col. 6, claim 1 line 47 — Delete " int eh " and substitute -- in the --

Col. 6, claim 5 line 62 — Delete " int he " and substitute -- in the --

Col. 8, claim 11 line 1 — Delete " ration " and sub -- ratio --

Col. 8, claim 14 line 15 — Delete " 1 " and substitute -- 13 --

Signed and Sealed this

Twenty-eighth Day of April, 1992

*Attest:*

HARRY F. MANBECK, JR.

*Attesting Officer*

*Commissioner of Patents and Trademarks*